United States Patent [19]

Brown

[11] 4,240,552

[45] Dec. 23, 1980

[54] DISPLAY PACKAGE

[75] Inventor: James W. Brown, Los Angeles, Calif.

[73] Assignee: C. R. Laurence Co., Inc., Los Angeles, Calif.

[21] Appl. No.: 19,339

[22] Filed: Mar. 12, 1979

[51] Int. Cl.[3] ..... B65D 65/16; B65D 75/58

[52] U.S. Cl. ..... 206/459; 206/461

[58] Field of Search ..... 206/461, 462, 463, 459, 206/465, 471, 469

[56] References Cited

U.S. PATENT DOCUMENTS

| | | | |
|---|---|---|---|
| 3,103,774 | 9/1963 | Wall | 206/459 |
| 3,394,802 | 7/1968 | Hershaft | 206/461 |
| 3,933,245 | 7/1976 | Mullen | 206/461 |

FOREIGN PATENT DOCUMENTS

| | | | |
|---|---|---|---|
| 1048145 | 7/1953 | France | 206/461 |

*Primary Examiner*—William T. Dixson, Jr.
*Attorney, Agent, or Firm*—Keith D. Beecher

[57] ABSTRACT

A display package for replacement hardware parts, or other merchandise and products, is provided which comprises a cardboard backing card and a transparent plastic member mounted on the card to form an enclosure for the merchandise; the transparent plastic member being shaped to cause the enclosure to have a first section of substantial depth for containing and displaying the merchandise, and a second section of minimal depth for containing and displaying an insert which has indicia describing the merchandise imprinted thereon. A feature of the package is that it can be used for a wide variety of products since all descriptive matter concerning the products is imprinted on the insert, rather than on the package itself, and different inserts can be placed in the package for different products.

3 Claims, 4 Drawing Figures

FIG. 1
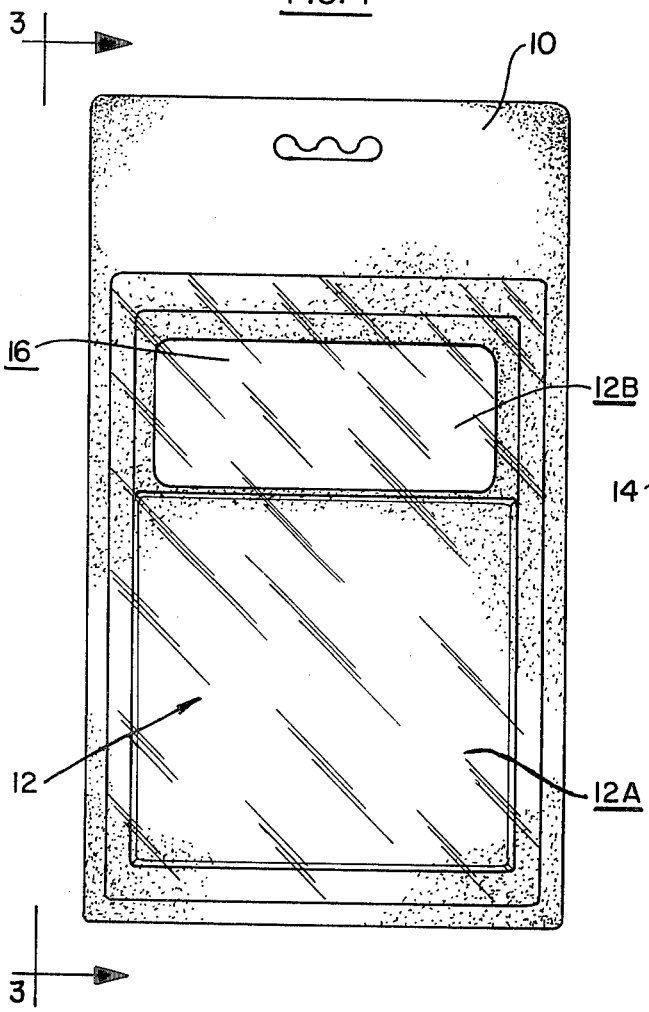
FIG. 2
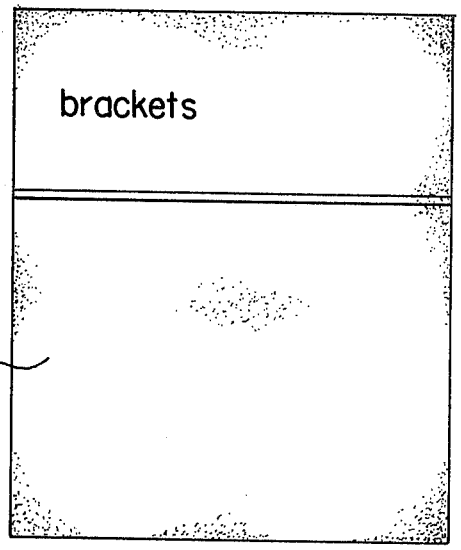
FIG. 3
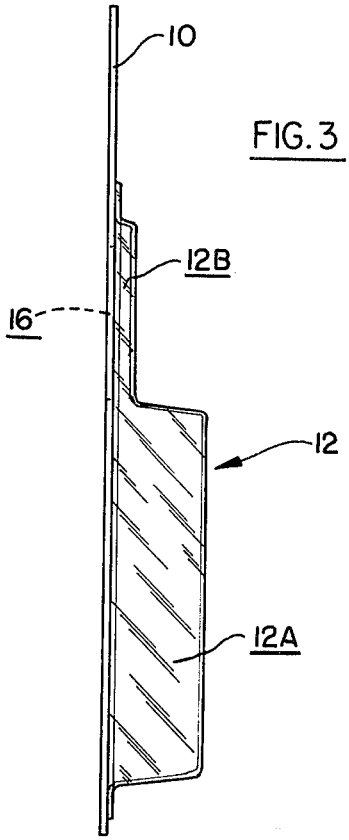
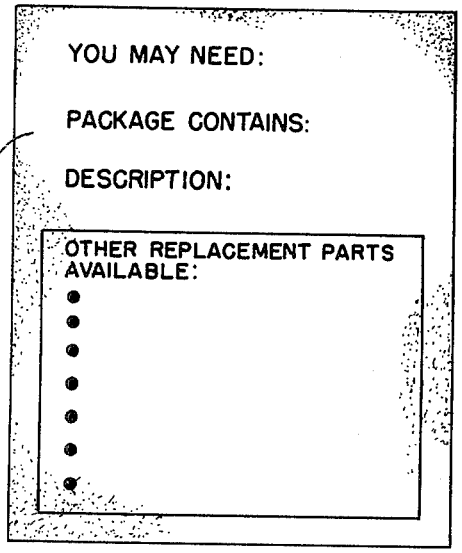
FIG. 4

DISPLAY PACKAGE

BACKGROUND

Display packages which comprise a transparent plastic "bubble" mounted on a card which is intended to be hung on a display rack, are in widespread present-day use for merchandising a wide variety of products. A feature of such display packages is that they firmly contain the products and, at the same time, permit the products themselves to be displayed to the potential purchasers.

It is usual in such packages for the card to contain an advertising message and a description of the products contained in the package. However, this means that the manufacturer or wholesaler must purchase separate display packages for each of the different products, and this can complicate the distribution operations, especially where a wide range of products are concerned.

The package of the present invention, as mentioned above, may be used for a wide variety of products, so that the manufacturer or wholesaler need only order one type of package. This is achieved by constructing the package to have a shape so that an insert may be placed into the package together with the product, to be displayed through the transparent member, the insert containing a description of the product.

BRIEF DESCRIPTION OF THE DRAWING

FIG. 1 is a front elevation showing the package of the invention, which comprises a backing card, and a transparent plastic member mounted on the card to form an enclosure;

FIG. 2 is a view of the front of an insert which is contained in the transparent enclosure of the package of FIG. 1, together with appropriate products, and which contains indicia which are displayed through the transparent member;

FIG. 3 is a side elevation of the package of FIG. 1; and

FIG. 4 is a view of the rear face of the insert of FIG. 2 a portion of which is displayed through an opening in the backing card of the package of FIG. 1.

DETAILED DESCRIPTION OF THE PRESENTLY PREFERRED EMBODIMENT

The display package of FIG. 1 includes a backing card 10 which, as illustrated, has a rectangular shape, and which is intended to be hung from a display bracket, so that the card, and the contents of its enclosure may be displayed to potential purchasers.

The backing card 10 has a transparent member 12 attached to it to form an enclosure, the transparent member being formed, for example, of appropriate transparent plastic material. The transparent plastic member 12 is shaped so that the enclosure has two sections, a first section 12A of substantial depth and a second section 12B of minimal depth. Each section in the illustrated embodiment, has a solid rectangular configuration.

An insert 14 (FIG. 2) is intended to be contained in the section 12B of the enclosure, and which extends into the section 12A; together with the products to be displayed (not shown) which are contained in section 12A. The insert 14 has indicia imprinted on its front face, as shown in FIG. 2, which are displayed through the transparent member 12. The indicia shown in FIG. 2, for example, describes the contents of the section 12A of the transparent enclosure.

The backing card 10 also has a window, or opening 16, facing the section 12B of the enclosure. As shown in FIG. 4, the rear face of the insert 14 may have other indicia, some of which is displayed through the opening 16, so that the potential purchaser may be furnished with further information concerning the contents of the package, and additional products which he may require.

As mentioned above, a feature of the package of the present invention is that the package itself may serve for the display of a wide variety of different products, in each instance, a separate insert 14 being provided for each of the different products.

It will be appreciated that while a particular embodiment. of the invention has been shown and described, modifications may be made. It is intended in the claims to cover all the modifications which come within the spirit and scope of the invention.

What is claimed is:

1. A display package comprising: a card forming a backing for the package, a transparent plastic member mounted on the card to form an enclosure, said enclosure having a first section of substantial depth for containing the products to be displayed by the package, and said enclosure having a second section of minimal depth positioned adjacent to said first section; and an insert contained in said second section, said insert having indicia thereon describing the contents of the first section of the enclosure.

2. The display package defined in claim 1, in which said first and second sections of said enclosure each has a solid rectangular configuration.

3. The display package defined in claim 1, in which said card has an opening therein facing the first section of said enclosure to reveal the rear surface of said insert, and said rear surface of said insert having further indicia thereon.

* * * * *